United States Patent [19]

Lurix

[11] 4,319,887

[45] Mar. 16, 1982

[54] DISTILLATE FUEL ADDITIVES

[75] Inventor: Paul Lurix, Bernardsville, N.J.

[73] Assignee: Keyline Research & Development Corporation, Rutherford, N.J.

[21] Appl. No.: 147,587

[22] Filed: May 7, 1980

[51] Int. Cl.[3] ..... C10L 1/22

[52] U.S. Cl. ..... 44/72; 44/57; 44/62

[58] Field of Search ..... 44/72, 57, 62; 585/13, 585/26

[56] References Cited

U.S. PATENT DOCUMENTS

| | | | |
|---|---|---|---|
| 2,891,853 | 6/1959 | Niedzielski | 44/57 |
| 3,093,623 | 6/1963 | Ilnyckyj | 44/62 |
| 3,410,670 | 11/1968 | LeSuer | 44/57 |
| 3,638,349 | 1/1972 | Wisotsky et al. | 44/62 |
| 3,703,361 | 11/1972 | Konecky | 585/13 |
| 3,862,825 | 1/1975 | Sweeney | 44/62 |

*Primary Examiner*—Winston A. Douglas
*Assistant Examiner*—Y. Harris-Smith
*Attorney, Agent, or Firm*—LeBlanc, Nolan, Shur & Nies

[57] ABSTRACT

Distillate fuel additives containing an activator for increasing the efficiency with which the fuel can be burned, a pour point depressant, a dispersant, and a base stock or carrier for the foregoing constituents.

8 Claims, No Drawings

DISTILLATE FUEL ADDITIVES

The present invention relates to fuel additives and, more specifically, to certain novel additives of that character which are particularly designed for distillate fuels.

My novel fuel additives contain a combustion modifier, a pour point depressant, and a dispersant for the fuel molecules. These constituents are compounded with a base stock or carrier in which they can be homogeneously distributed in appropriate concentrations.

The foregoing additives are particularly designed for use with No. 1 and No. 2 diesel fuels; and the principles of the present invention will accordingly be developed primarily by reference to diesel fuel applications. This is not intended to limit the scope of patent protection to which I consider myself entitled, however, as those additives can also be advantageously used to improve the performance of No. 2 heating oil.

The diesel fuels with which I am concerned are mixtures of hydrocarbons having boiling points ranging from approximately 330° to 620° F.

The burning of such fuels in internal combustion engines—the use to which the present invention is primarily devoted—involves: (a) the introduction of warm air into a combustion chamber followed by; (b) injection of the fuel in spray form into the combustion chamber; and (c) mixing of the fuel and air and compression of the mixture; with (d) ensuing ignition and combustion of the fuel; and (e) exhausting of combustion products from the chamber.

The fuel molecules ignite individually, and combustion of the molecules charged to the combustion chamber therefore does not occur simultaneously. As a consequence, optimum combustion requires that the fuel molecules be separated as widely as possible in the combustion mixture so that the latter will approach an "ideal vapor".

However, prior to ignition and even to injection into the combustion chamber, the fuel molecules tend to agglomerate or coagulate, inhibiting the formation of the wanted molecular dispersion of the fuel in the fuel-air mixture and reducing combustion efficiency. Also, the agglomerates tend to adhere to fuel injector and other surfaces in the form of gums and varnishes, thereby causing sticking, plugging and fuel leakage, all of which lead to increased fuel consumption and an unwanted increase in exhaust smoke.

The dispersants I employ in the distillate fuel additives disclosed herein inhibit the coagulation or agglomeration of hydrocarbon molecules of the character found in distillate fuels. This contributes to efficient combustion and consequent reductions in fuel consumption and smoke formation, both by making the formation of a more perfect molecular dispersion of fuel in the fuel-air mixture possible and by inhibiting the build-up of insoluble, gummy deposits and varnishes in the fuel injector and elsewhere.

In fact, it has been shown in actual field tests that varnish and gummy deposits in the injectors of diesel truck engines operated on fuels treated with my novel additives had actually been dissolved when the injectors were subsequently disassembled for scheduled routine maintenance.

Essentially, any composition that is capable of performing the functions stated above can be employed as a dispersant in my fuel additives. One that I have successfully used is decahydronaphthlene. This composition is commercially available from E. I. de Pont de Nemours and Company under the name Decalin; it has the formula:

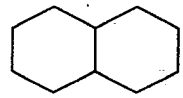

A second major constituent of my fuel additives is the combustion modifier.

Part of the hydrocarbon molecules in any charge will tend to form "free carbon" during the early stages of the combustion process because of dehydrogenation of those molecules. The energy required to combust carbon to carbon dioxide is much higher than that which is in many cases locally available from the combustion of the remaining hydrocarbon molecules. Consequently, the bulk of the carbon is exhausted from the combustion chamber in that form, appearing as a "black smoke" in the exhaust gases. This, again, is undesirable from the viewpoints of fuel consumption and atmospheric pollution.

The combustion modifiers I employ supress the dehydrogenation of the distillate fuel molecules and also catalyze the carbon to carbon dioxide oxidation reactions, thus reducing consumption and smoke formation.

Again, my invention is not limited to the use of one particular composition for the purposes just described as it is the function of the constituent, not its chemical composition, which is critical. Exemplary of the compositions which I can employ as combustion modifiers are those generically termed organometallic complexes. One particular material of this character I have successfully employed is Lubrizol 565 which is preferred because it also has some dispersant properties that make its use for that additional purpose worthwhile. That material is a barium amine complex which is marketed by the Lubrizol Corporation and which has the following significant properties:

| | | |
|---|---|---|
| Physical Characteristics: | | |
| Specific Gravity at 60° F. (15.6° C.) | 1.22 approx. | |
| Pounds per U.S. Gallon at 60° F. | 10.16 approx. | |
| Pounds per IMP. Gallon at 60° F. | 12.20 approx. | |
| Viscosity at 100° C., cSt | 9.62 approx. | |
| Pour Point | −10° F. (−23° C.) | |
| Chemical Characteristics: | | |
| Weight Percent of: | Minimum | Maximum |
| Barium | 20.0 | 25.0 |
| Sulfur | 0.25 | 0.50 |
| Nitrogen | 0.4 | 0.6 |

Other compositions of this character are also usable as are various barium sulfonate complexes, calcium amine and sulfonate complexes, and alkylated manganeses. That such compositions are known and available is evidenced by U.S. Pat. Nos.: 2,258,297 issued Oct. 7, 1941, to Pharis Miller and Gould H. Cloud; 2,891,853 issued June 23, 1959, to Edmund L. Niedzielski; 3,249,540 issued May 3, 1966, to Paul Y. C. Gee and Harry J. Andress; 3,249,541 issued May 3, 1966, to Paul Y. C. Gee and Harry J. Andress; 3,410,670 issued Nov. 12, 1968, to William M. LeSuer; 3,574,101 issued Apr. 6, 1971, to John P. Murphy; 3,652,616 issued Mar. 28, 1972, to Roger N. Watson, William T. Brannen and Warren N. Hillstrom; 3,791,804 issued Feb. 12, 1974, to William T. Brannen and Roger W. Watson; 3,791,805 issued Feb. 12, 1974, to William T. Brannen and Roger W. Watson; 3,836,469 issued Sept. 12, 1974, to Clark Ober Miller; 3,836,470 issued Sept. 12, 1974, to Clark Ober Miller; 3,838,050 issued Sept. 24, 1974, to Clark Ober Miller; and 3,879,308 issued Apr. 22, 1975, to Clark Ober Miller.

The third active ingredient of my distillate fuel additives is a pour point depressant.

At commonly reached, lower temperatures paraffin waxes separate out of the fuels with which I am concerned in particles of varying size. This can result in clogged fuel lines and filters and in plugged injectors. Precipitation of these waxes can be inhibited, and the useful temperature range of a particular distillate fuel increased, by adding a pour point depressant to the fuel.

I accomplish this same useful result by incorporating a pour point depressant in the novel fuel additives disclosed herein.

Pour point depressants for diesel fuels are well-known. They are, for example, described in U.S. Pat. Nos. 2,403,267 issued July 2, 1946, to Garland H. Davis; 3,037,850 issued June 5, 1962, to Stephen L. Wythe and William C. Hollyday; 3,100,695 issued Aug. 13, 1963, to Roman S. Slysh and William C. Hollyday; 3,236,612 issued Feb. 22, 1966, to Stephan Ilnyckyj; 3,341,309 issued Sept. 12, 1967, to S. Ilnyckyj; 3,374,073 issued Mar. 19, 1973, to William C. Gergel; 3,726,653 issued Apr. 10, 1968, to Pieter H. van der Meij and Rudolf H. Bloembergen; 3,842,106 issued Oct. 15, 1974, to Anatoli Onopchenko and Johann G. D. Schulz; and 3,955,940 issued May 11, 1976, to William C. Hollyday; and it is to be understood that it is the use of a pour point depressant which is compatible with the combustion modifier and dispersant that is critical in the practice of my invention, not the specific chemical composition of the depressant.

One pour point depressant that I have found particularly suitable in that it is compatible with the specific combustion modifier and dispersant identified above is Nalco 8RK-344. That depressant, which is available from the Nalco Chemical Company, has been identified by its manufacturer as a waxy, high molecular weight ethylene-vinyl acetate copolymer with the following typical physical properties:

| | |
|---|---|
| Specific Gravity at 60° F. | 0.89 |
| Density, lbs/gal | 7.39 |
| Flash Point, PMCC | 140° F. |
| Melting Point, °F. | +35° F. |
| Viscosity, ctks | |
| at 100° F. | 79.7 |
| at 60° F. | 199.0 |
| Ash | Nil |
| Appearance | Pale yellow liquid |

The final constituent of the distillate fuel additives I have invented is a base stock or carrier for the additive components described above. Kerosene is a satisfactory base stock as are other liquid hydrocarbon compositions such as No. 1 and No. 2 diesel fuels and No. 2 fuel oil meeting the specifications of ASTM Standard D975-78.

In addition to the particular combination of constituents identified above, the concentrations of those constituents in the additive are also critical in the practice of my invention. At least for the exemplary constituents identified above in a kerosene carrier, these concentrations are:

| Component | Volume Percent |
|---|---|
| Combustion Modifier | 80 ± 2 |
| Pour Point Depressant | 10 ± 0.5 |
| Dispersant | 2 ± 0.1 |
| Carrier | Balance |

The additive can be formulated by heating the combustion modifier to 75°–80° F. and then adding the base stock with mechanical stirring for five minutes. While maintaining the temperature in the foregoing range, the dispersant and pour point depressant are added in that order; and stirring is continued for 18–20 minutes to insure that a homogeneous mixture is formed.

Formulation of the additive by the procedure just described can be carried out in any suitable equipment—a laboratory beaker equipped with a stirrer or conventional blending equipment, for example.

The additive is blended with the diesel fuel or heating oil at the rate of one pint of additive per 50 gallons of fuel or oil. The addition can be made batchwise or the additive can be continuously dosed to the fuel at a rate providing the distillate fuel-additive ratio identified above.

The amount in which the additive is employed is also important. Reductions to 0.8 pint of additive per 50 gallons of diesel fuel resulted in ineffective dispersion of the fuel molecules and a consequent loss of the advantages appurtenant to effective dispersion. Additions exceeding one pint per 50 gallons did not cause any harmful effects, but nothing was gained as the reduction in smoke and other benefits were minimal compared with the increase in the amount of additive. From the economic viewpoint, therefore, the use of more than one pint of additive per 50 gallons of fuel may not be justified because of the cost of obtaining the smaller gains in performance that can be realized by using more additive.

The addition of multiple compositions to untreated diesel fuels to modify their characteristics is not uncommon; and this practice is in fact described in U.S. Pat. Nos. 3,676,483 issued July 11, 1972, to Shih-En Hu; and 3,879,308 issued Apr. 22, 1975, to Clark Ober Miller. However, I am not aware of any multiple constituent distillate fuel additives employing my particular combination of combustion modifier, dispersant, and pour point depressant, let alone the particular relative concentrations of ingredients I have found essential; and I know of nothing suggesting that the additive should be formulated with the fuel in the amount which I employ.

From the foregoing it will be apparent to the reader that the primary object of the present invention is the provision of novel, improved additives for distillate fuels.

Other also important but more specific objects of my invention reside in the provision of distillate fuel additives which:

- are capable of improving fuel combustion efficiency and otherwise reducing fuel consumption;
- are capable of inhibiting free carbon formation in the fuel combustion process and of thereby reducing the concentration of particulate solids in the combustion products;

contain a combustion modifier, a dispersant, and a pour point depressant blended with an appropriate base stock or carrier.

Certain important objects of the present invention have been identified above. Other important objects and advantages and additional novel features of the invention will be apparent to those skilled in the relevant arts from the foregoing general description of the invention; from the appended claims; and from the following examples, which are intended to illustrate and not restrict the scope of the invention.

A diesel fuel additive was formulated by the procedure described above from the following constituents:

| Component | Volume Percent |
|---|---|
| Lubrizol 565 | 80.0 |
| Nalco 8RK-344 | 10.0 |
| Decahydronaphthlene | 2.0 |
| Kerosene | 8.0 |

The additive was blended with No. 2 diesel fuel meeting the specifications of ASTM D 975-78.

Both the treated and untreated fuels were subjected to analysis in accord with, and employing the procedures described in, the appropriate ASTM Standards. The results are tabulated below:

| Test | Untreated Fuel | Treated Fuel |
|---|---|---|
| API Gravity at 60° F. | 36.9 | 36.9 |
| Flash Point, °F. | 162 | 162 |
| Cloud Point, °F. | +2 | −4 |
| Pour Point, °F. | −10 | −25 |
| Water and Sediment, % Vol. | <0.05 | <0.05 |
| Carbon Residue on 10% Residue, % wt. | 0.13 | 0.09 |
| Ash | 0.003 | 0.003 |
| Viscosity at 100° F., sus. | 34.8 | 34.8 |
| Sulfur, % wt. | 0.15 | 0.15 |
| Cetane Number | 48 | 51 |
| Heat of Combustion, BTU/lb | 19,650 | 20,800 |

Consumption of the treated and untreated fuels was compared at sea in the 700 KVA onboard generators of a 42,000 ton dead weight diesel-powered tanker. These generators were selected because of continuous, steady state operation and because sophisticated monitoring and data recording equipment was available.

The average fuel consumption of the generators prior to the test was 2.1 tons per day. Over a three-day test period, fuel consumption dropped to 1.9 tons per day, an improvement of better than 9.5%.

Diesel fuels treated as in the just described shipboard test have also been tested in long-haul trucks and in trucks making short hauls in a large metropolitan area.

One typical truck operator reported on a recurring haul (same route, cargo weight, etc.) of about 4700 miles that mileage increased from an average of 5.3–5.5 miles per gallon for previous trips to an average of 7.8 miles per gallon on the fuel treated with my additive, resulting in a $266.34 savings in fuel costs, taking into account the cost of the additive.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and equivalency of the claims are therefore intended to be embraced therein.

What is claimed and desired to be secured by United States Letters Patent is:

1. A mixture of a distillate fuel and a distillate fuel additive, said additive comprising: a homogeneous mixture of a decahydronaphthlene dispersant in an amount effective to inhibit coagulation and agglomeration of the fuel molecules, thereby impeding the formation of varnishes and gums and promoting the more efficient combustion of the fuel; a barium amine complex combustion modifier in an amount effective to inhibit the formation of free carbon during the combustion of said fuel and to catalyze the oxidation of said carbon; an effective amount of a pour point depressant which is an ethylene-vinyl acetate copolymer; and a liquid hydrocarbon carrier which is a kerosene, a No. 1 or No. 2 diesel fuel, or a No. 2 fuel oil.

2. A mixture as defined in claim 1 which contains not less than about one pint of additive per 50 gallons of distillate fuel, said additive consisting essentially of:

| Component | Volume Percent |
|---|---|
| Combustion Modifier | 80 ± 2 |
| Pour Point Depressant | 10 ± 0.5 |
| Dispersant | 2 ± 0.1 |
| Liquid Hydrocarbon Carrier | Balance. |

3. A mixture as defined in either of the preceding claims 1 or 2 in which the distillate fuel is a No. 1 or No. 2 diesel fuel or a No. 2 heating oil.

4. A method of reducing the consumption of a distillate fuel and the concentration of solid particulates in the products generated in the combustion of said fuel, said method comprising the step of adding to said fuel at a rate of not less than about one pint per 50 gallons of fuel a distillate fuel additive as defined in claim 1.

5. A method as defined in claim 4 in which the fuel to which the additive is added is a No. 1 or No. 2 diesel fuel or a No. 2 heating oil.

6. A distillate fuel additive comprising a homogeneous blend of a decahydronaphthlene dispersant in an amount effective to inhibit coagulation and agglomeration of the fuel molecules, thereby impeding the formation of varnishes and gums and promoting the more efficient combustion of the fuel; a barium amine complex combustion modifier in an amount effective to inhibit the formation of free carbon during the combustion of said fuel and to catalyze the oxidation of said carbon; an effective amount of a pour point depressant which is an ethylene-vinyl acetate copolymer; and a liquid hydrocarbon carrier which is a kerosene, a No. 1 or No. 2 diesel fuel, or a No. 2 fuel oil.

7. A distillate fuel additive as defined in claim 6 in which the aforesaid constituents are present in the following proportions:

| COMPONENT | VOLUME PERCENT |
|---|---|
| Combustion Modifier | 80 ± 2 |
| Pour Point Depressant | 10 ± 0.5 |
| Dispersant | 2 ± 0.1 |
| Liquid Hydrocarbon Carrier | Balance. |

8. A distillate fuel additive comprising a homogeneous blend of a decahydronaphthlene dispersant in an amount effective to inhibit coagulation and agglomeration of the fuel molecules, thereby impeding the formation of varnishes and gums and promoting the more efficient combustion of the fuel; a barium amine complex combustion modifier in an amount effective to inhibit the formation of free carbon during the combustion of said fuel and to catalyze the oxidation of said carbon; an effective amount of a pour point depressant which is an ethylene-vinyl acetate copolymer; and a liquid hydrocarbon carrier which is a kerosene, a No. 1 or No. 2 diesel fuel, or a No. 2 fuel oil, the aforesaid components being present in the following proportions:

| COMPONENT | VOLUME PERCENT |
|---|---|
| Combustion Modifier | 80 ± 2 |
| Pour Point Depressant | 10 ± 0.5 |
| Dispersant | 2 ± 0.1 |
| Liquid Hydrocarbon Carrier | Balance. |

* * * * *